US009671708B2

(12) United States Patent
Yoshida et al.

(10) Patent No.: US 9,671,708 B2
(45) Date of Patent: Jun. 6, 2017

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Kana Yoshida, Kanagawa (JP); Atsushi Sugawara, Kanagawa (JP); Tsuyoshi Murakami, Kanagawa (JP); Yukiaki Nakamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 2 days.

(21) Appl. No.: 14/711,233

(22) Filed: May 13, 2015

(65) Prior Publication Data

US 2016/0124334 A1 May 5, 2016

(30) Foreign Application Priority Data

Oct. 30, 2014 (JP) ..... 2014-221442

(51) Int. Cl.

| | |
|---|---|
| ***G03G 9/093*** | (2006.01) |
| ***G03G 9/087*** | (2006.01) |
| ***G03G 9/09*** | (2006.01) |
| ***G03G 9/08*** | (2006.01) |

(52) U.S. Cl.

CPC ..... *G03G 9/09335* (2013.01); *G03G 9/0827* (2013.01); *G03G 9/08755* (2013.01); *G03G 9/0904* (2013.01); *G03G 9/09371* (2013.01)

(58) Field of Classification Search

CPC . G03G 9/0821; G03G 9/0825; G03G 9/08755
See application file for complete search history.

(56) References Cited

U.S. PATENT DOCUMENTS

2003/0186152 A1* 10/2003 Ohno ..... G03G 9/0819 430/108.8
2009/0087771 A1* 4/2009 Sawada ..... G03G 9/107 430/110.2
2011/0318053 A1* 12/2011 Yamashita ..... G03G 9/0804 399/112

FOREIGN PATENT DOCUMENTS

JP 2002-006541 A 1/2002

* cited by examiner

*Primary Examiner* — Peter Vajda
(74) *Attorney, Agent, or Firm* — Oliff PLC

(57) ABSTRACT

An electrostatic charge image developing toner includes a toner particle that has a sea-island structure including a sea portion containing a binder resin and an island portion containing a release agent and having at least two maximum values of distribution of a degree of uneven distribution B of the island portion shown by the following Equation (1):

degree of uneven distribution $B=2d/D$ Equation (1)

in Equation (1), D represents an equivalent circle diameter (μm) of the toner particle obtained by cross section observation of the toner particle, and d represents a distance (μm) between the center of gravity of the toner particle and the center of gravity of the island portion containing the release agent obtained by cross section observation of the toner particle.

17 Claims, 5 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2014-221442 filed Oct. 30, 2014.

BACKGROUND

1. Technical Field

The present invention relates to an electrostatic charge image developing toner, an electrostatic charge image developer, and a toner cartridge.

2. Related Art

A method of visualizing image information, such as electrophotography, is currently used in various fields. In electrophotography, an electrostatic charge image is formed on a surface of an image holding member as image information through charging and electrostatic charge image formation. A toner image is formed on the surface of the image holding member using a developer containing a toner, and this toner image is transferred to a recording medium, and then the toner image is fixed onto a surface of the recording medium. The image information is visualized as an image through these processes.

SUMMARY

According to an aspect of the invention, there is provided an electrostatic charge image developing toner including:

a toner particle that has a sea-island structure including a sea portion containing a binder resin and an island portion containing a release agent and having at least two maximum values of distribution of a degree of uneven distribution B of the island portion shown by the following Equation (1):

$$\text{degree of uneven distribution } B=2d/D \qquad \text{Equation (1)}$$

in Equation (1), D represents an equivalent circle diameter (μm) of the toner particle obtained by cross section observation of the toner particle, and d represents a distance (μm) between the center of gravity of the toner particle and the center of gravity of the island portion containing the release agent obtained by cross section observation of the toner particle.

BRIEF DESCRIPTION OF THE DRAWINGS

Exemplary embodiments of the present invention will be described in detail based on the following figures, wherein.

DETAILED DESCRIPTION

Figure 1:
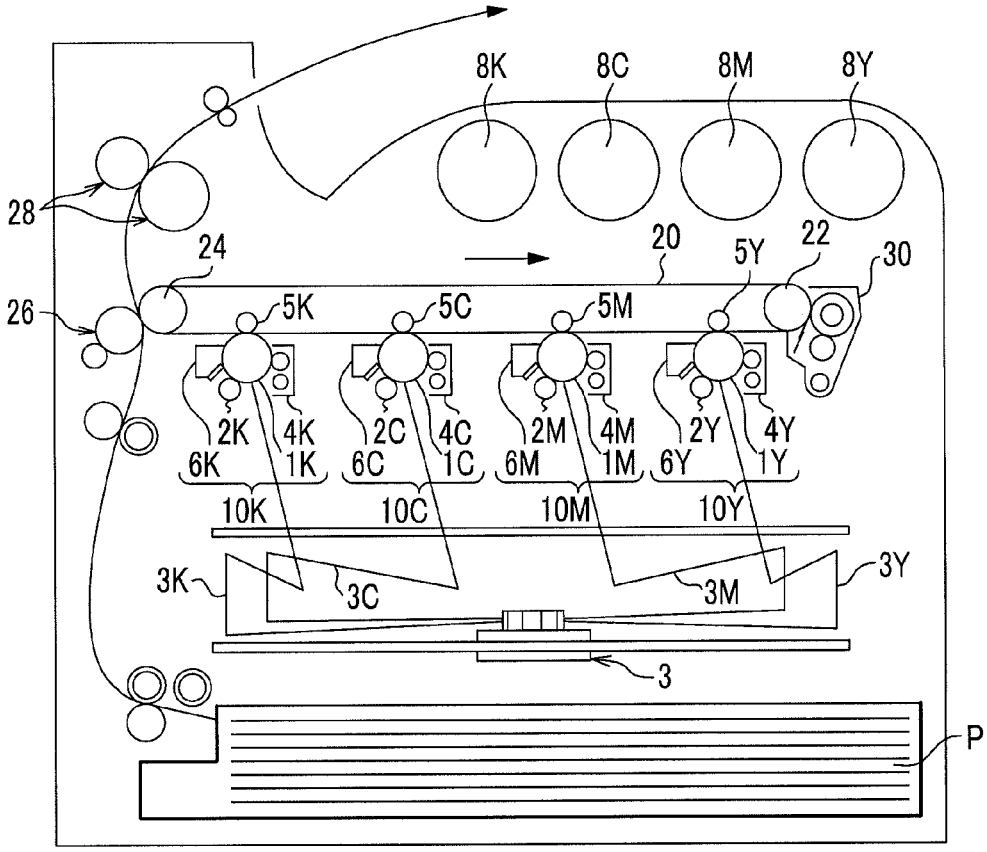
FIG. 1 is a schematic configuration diagram showing an example of an image forming apparatus according to the exemplary embodiment.

Hereinafter, exemplary embodiments which are examples of the invention will be described in detail.

Electrostatic Charge Image Developing Toner

An electrostatic charge image developing toner according to the exemplary embodiment (hereinafter, referred to as a "toner") contains a toner particle having a sea-island structure including a sea portion containing a binder resin and an island portion containing a release agent.

In the sea-island structure of the toner particle, there are at least two maximum values of distribution of a degree of uneven distribution B of the island portion shown by the following Equation (1).

$$\text{degree of uneven distribution } B=2d/D \qquad \text{Equation (1)}$$

(in Equation (1), D represents an equivalent circle diameter (μm) of the toner particle obtained by cross section observation of the toner particle, and d represents a distance (μm) between the center of gravity of the toner particle and the center of gravity of the island portion containing the release agent obtained by cross section observation of the toner particle.)

With the above configuration, the toner according to the exemplary embodiment may form an image having excellent bending resistance and abrasion resistance, even in a case of forming an image on cardboard for packaging, for example, as a recording medium.

The reason thereof is not clear but the following is assumed.

In the related art, a toner containing a release agent in a toner particle has been known as a toner used for electrophotographic image forming (also referred to as printing). In a case of using such toner of the related art, the release agent bleeds from the inside of the toner particle to the surface thereof by heating and pressurization at the time of fixation, release characteristics of a recording medium are expressed, and accordingly, excellent fixing performance is obtained.

In the toner particle containing the release agent unevenly distributed on the surface side, the release agent easily bleeds to the surface at the time of fixation. Accordingly, in the toner having such a property, the release characteristics are improved.

In addition, in a case of a toner particle in which the release agent is present in the toner particle, the toner is easily melted at a temperature at the time of fixation, due to the presence of the release agent. However, the release agent present in the toner particle hardly bleeds by heating and pressurization in a period of the fixation, and as a result, the release agent may remain in a mixed state with the binder resin in a fixed image. If the release agent remains in the fixed image as described above, the release agent which originally has low compatibility with the binder resin may decrease the mechanical strength of the fixed image.

Meanwhile, in packaging of products such as confectioneries, paper casing is generally used, and a method of printing a color image on a part of or the entirety of cardboard (coated cardboard) and assembling the cardboard in a three-dimensional form is widely performed. In such printing, offset printing is generally used, but in recent years, in the printing industry, not only high quality, but low cost and shorter delivery times have been required, and use of digital data has been advanced in the design confirmation, start of the printing, and the like, and there is increasing demand in the electrophotographic printing market.

When the mechanical strength of a printed image on such a cardboard for packaging is low, image cracking of a bent portion during assembly of the case and image peeling due to abrasion may occur. Accordingly, when performing the electrophotographic printing on the cardboard for packaging, excellent peeling characteristics are required and improvement of the mechanical strength such as bending resistance and abrasion resistance of an image is needed.

Herein, in the toner particle, a degree of uneven distribution B of the island portion containing the release agent (hereinafter, also referred to as a "release agent domain") is an index showing how far the center of gravity of the release agent domain is separated from the center of gravity of the toner particle. The degree of uneven distribution B shows that as the value becomes greater, the release agent domain is present closer to the surface of the toner particle, and that as the value becomes smaller, the release agent domain is present closer to the center of gravity of the toner particle. The maximum value of the distribution of the degree of uneven distribution B shows that there are peaks in the distribution of the release agent domain in a radial direction of the toner particle.

That is, regarding the toner particle having at least two maximum values of the distribution of the degree of uneven distribution B of the release agent domain, at least, maximum values are present in an area close to the surface side of the toner particle and an area on the side of the center of gravity of the toner particle with respect to the area described above.

Figure 5:
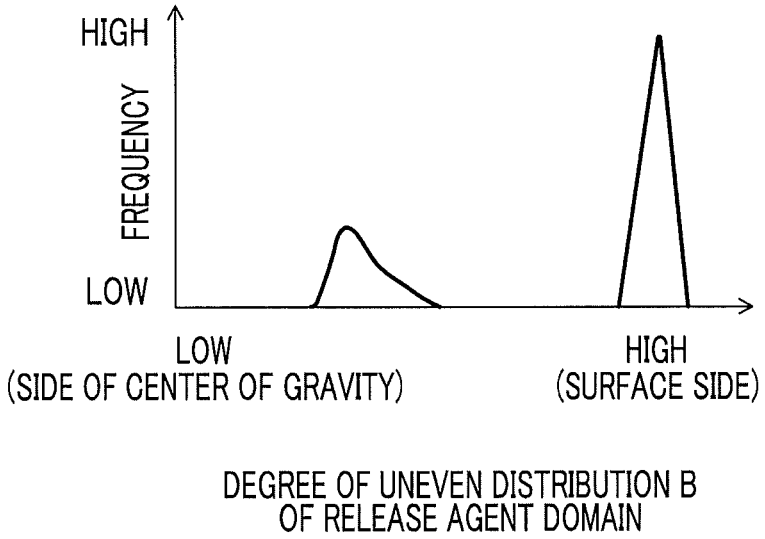
FIG. 5 is a schematic view showing an example of distribution of a degree of uneven distribution B of a release agent domain of toner according to the exemplary embodiment.

More specifically, as shown in FIG. 5, the toner according to the exemplary embodiment, for example, has a greater maximum value in the area close to the surface side of the toner particle (for example, corresponding to a maximum value b1 which will be described later) and a smaller maximum value in the area on the side of the center of gravity of the toner particle with respect to the area described above (for example, corresponding to a maximum value a1 which will be described later). Herein, FIG. 5 is a schematic view showing an example of the distribution of the degree of uneven distribution B of the release agent domain of the toner according to the exemplary embodiment.

The release agent present in the area close to the surface side of the toner particle rapidly bleeds to the surface by heating and pressurization in the period of the fixation and improves the peeling characteristics at the time of fixation.

Meanwhile, a part of the release agent present in the area on the side of the center of gravity of the toner particle with respect to the release agent described above, is compatible with the binder resin in the toner particle, and accordingly, the binder resin is easily melted at the time of fixation, compared to a case where only the binder resin is present. As a result, fixing properties of the binder resin (toner particle) may be improved. The release agent not involved in compatible with the binder resin bleeds through a passage through which the release agent present in the area close to the surface side of the toner particle has bleeded. As a result, an increase in a residual amount on the fixed image is prevented, even though the release agent is present in the toner particle.

Accordingly, the toner according to the exemplary embodiment has the peeling characteristics for the recording medium at the time of fixation, prevents the increase in the residual amount of the release agent on the fixed image, and improves the mechanical strength such as the bending resistance and the abrasion resistance of the image.

As described above, the toner according to the exemplary embodiment is expected to have peeling characteristics for the cardboard at the time of fixation and form an image having excellent bending resistance and abrasion resistance, even when forming an image on the cardboard for packaging described above.

Herein, as the cardboard of the exemplary embodiment, a cardboard having a thickness in a range of 0.15 mm to 0.23 mm is preferable, and when the thickness thereof is in the range described above, plain paper or coated paper including a coated layer may be used.

Hereinafter, the toner according to the exemplary embodiment will be described in detail.

The toner according to the exemplary embodiment at least includes the toner particle, and if necessary, may include an external additive attached to the surface of the toner particle.

Toner Particle

First, the toner particle will be described.

As described above, the toner particle has the sea-island structure including the sea portion containing the binder resin and the island portion containing the release agent. That is, the toner particle has the sea-island structure in which the release agent is present in a continuous phase of the binder resin in an island shape.

In the toner particle having the sea-island structure, there are at least two maximum values of the distribution of the degree of uneven distribution B of the release agent domain (island portion containing the release agent).

In order to make the release agent in the toner particle easily bleed by pressurization at the time of fixation and to form an image having excellent bending resistance and abrasion resistance, all maximum values of the distribution of the degree of uneven distribution B are preferably in a range of 0.35 to 1.00. That is, it is preferable that the release agent domain is not present in a position close to the center of gravity of the toner particle.

Particularly, in a viewpoint of heat retaining properties of the toner, the upper limit of the range of the maximum values is preferably equal to or smaller than 0.98.

In order to form an image having peeling properties for the cardboard at the time of fixation and excellent bending resistance and abrasion resistance, two values having the highest and second highest frequencies, respectively, among the maximum values of the distribution of the degree of uneven distribution B are a maximum value a1 in the range of 0.35 to 0.65 and a maximum value b1 in the range of 0.75 to 1.00, and the frequency of the maximum value a1 and the frequency of the maximum value b1 preferably satisfy a relationship of the following Equation (2).

$$\text{frequency of the maximum value } a1/\text{frequency of the maximum value } b1 = 0.2 \text{ to } 0.5 \qquad \text{Equation (2)}$$

That is, among the two or more maximum values, the maximum value having the highest frequency is the maximum value b1 present in a range of 0.75 to 1.00 and the maximum value having the second highest frequency is the maximum value a1 present in a range of 0.35 to 0.65.

Herein, the maximum value a1 is more preferably in a range of 0.4 to 0.6.

The maximum value b1 is more preferably in a range of 0.8 to 0.98.

The upper limit of the range of the maximum value b1 is preferably equal to or smaller than 0.98, from the viewpoint of heat retaining properties of the toner.

The value of the frequency of the maximum value a1/frequency of the maximum value b1 is more preferably from 0.30 to 0.45.

In addition, when the island portion configuring the peak including the maximum value a1 contains a first release agent and the island portion configuring the peak including the maximum value b1 contains a second release agent, a melting temperature of the first release agent is preferably higher than a melting temperature of the second release agent, in order to make the release agent in the toner particle more easily bleed by heating and pressurization in a period of the fixation, and to form an image having more excellent bending resistance and abrasion resistance.

Checking of Sea-Island Structure

Herein, a method of checking the sea-island structure will be described.

The sea-island structure of the toner particle is, for example, checked by a method of observing the cross section of the toner (toner particle) with a transmission electron microscope or a method of dyeing the cross section of the toner particle with ruthenium tetroxide and observing the cross section thereof with a scanning electron microscope. From the viewpoint that it is possible to more clearly observe the release agent domain of the cross section of the toner, a method of observing the cross section thereof with a scanning electron microscope is preferably used. As the scanning electron microscope, any scanning electron microscope which is well known by a person skilled in the art may be used, and for example, SU8020 manufactured by Hitachi High-Technologies Corporation or JSM-7500F manufactured by JEOL, Ltd. is used.

The observation method will be described in detail. First, after embedding the toner (toner particle) which is a measurement target in an epoxy resin, the epoxy resin is hardened. The hardened material is cut into a slice by a microtome including a diamond blade, and an observation sample having the exposed cross section of the toner is obtained. The sliced observation sample is dyed with ruthenium tetroxide, and the cross section of the toner is observed with a scanning electron microscope. Through this observation method, the sea-island structure in which the release agent having a luminance difference (contrast) is present in a continuous phase of the binder resin in an island shape, is observed on the cross section of the toner by a difference in dyed degrees.

Checking of Degree of Uneven Distribution B

Next, a method of checking the degree of uneven distribution B of the release agent domain will be described.

The checking of the degree of uneven distribution B of the release agent domain is performed as follows.

First, an image is recorded at a magnification with which one cross section of the toner (toner particle) is included in a field of view using the method of checking the sea-island structure. The image analysis of the recorded image is performed under conditions of 0.010000 μm/pixel using image analysis software (WinROOF manufactured by Mitani Corporation). Through the image analysis, the shape of the cross section of the toner particle is extracted by the luminance difference (contrast) between the epoxy resin which is used for embedding and the binder resin of the toner. A projected area is acquired based on the extracted shape of the cross section of the toner particle. The equivalent circle diameter is acquired from the projected area. The equivalent circle diameter is calculated by an expression of $2\sqrt{(\text{projected area}/\pi)}$. The acquired equivalent circle diameter is set as an equivalent circle diameter D of the toner particle in the observation of the cross section of the toner particle.

Meanwhile, a position of the center of gravity is acquired based on the extracted shape of the cross section of the toner particle. Specifically, a linear line which divides the cross section of the toner particle so as to have equivalent sizes of right and left areas and a linear line which divides the cross section of the toner particle so as to have equivalent sizes of upper and lower areas are created, and the intersection of the two linear lines is set as the center of gravity. This may be accurately measured in a short period of time by the image analysis. Next, the shape of the release agent domain is extracted by the luminance difference (contrast) between the binder resin and the release agent, and a position of the center of gravity of the release agent domain is acquired. Specifically, each position of the center of gravity may be measured in the same principle as that of the cross section of the toner particle. A distance between the center of gravity of the cross section of the toner particle and the center of gravity of the release agent domain is acquired. The acquired distance is set as a distance d between the center of gravity of the toner particle in the observation of the cross section of the toner particle and the center of gravity of the island portion containing the release agent.

Finally, from the equivalent circle diameter D and the distance d, the degree of uneven distribution B of the release agent domain is acquired using Equation (1) degree of uneven distribution $B=2d/D$.

The same operation is performed for each of the plural release agent domains present on the cross section of one toner particle, to acquire the degrees of uneven distribution B of the release agent domains.

Next, maximum values of the distribution of the degree of uneven distribution B of the release agent domain will be described.

First, the above-mentioned measurement of the degrees of uneven distribution B of the release agent domains is performed for 200 toner particles. A statistical analysis process is performed in regards to the obtained data of each degree of uneven distribution B of the release agent domain in data section in increments of 0.01 from 0 to 1.00, and the distribution of the degrees of uneven distribution B is determined.

If there are peaks in the obtained distribution, the value of the data section where the apex of the peak is present is set as the maximum value.

For example, as shown in the schematic view shown in FIG. 5, when a horizontal axis indicates the degree of uneven distribution B of the release agent domain (data section) and a vertical axis indicates the frequency thereof, if there are two peaks (mountain portions), the data sections of the degree of uneven distribution B where the apexes of the peaks are present are set as the maximum values.

Among the maximum values, the maximum value having the highest frequency (peak height) is referred to as a mode.

A method of satisfying the distribution characteristic of the degree of uneven distribution B of the release agent domain described above will be described when describing a method of preparing toner.

Next, components of the toner particle will be described.

The toner particle includes a binder resin and a release agent, and if necessary, includes a colorant. Hereinafter, each component will be described.

Binder Resin

Examples of the binder resins include a homopolymer consisting of monomers such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a vinyl resin formed of a copolymer obtained by combining two or more kinds of these monomers.

Examples of the binder resin include a non-vinyl resin such as an epoxy resin, a polyester resin, a polyurethane resin, a polyamide resin, a cellulose resin, a polyether resin, and a modified rosin, a mixture of these and a vinyl resin, or a graft polymer obtained by polymerizing a vinyl monomer in the presence thereof.

These binder resins may be used alone or in combination with two or more kinds thereof.

As the binder resin, a polyester resin is preferable.

As the polyester resin, a well-known polyester resin is used, for example.

Examples of the polyester resin include polycondensates of polyvalent carboxylic acids and polyols. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acids, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination with a diol. Examples of the tri- or higher-valent polyol include glycerin, trimethylolpropane, and pentaerythritol.

The polyols may be used alone or in combination of two or more kinds thereof.

A glass transition temperature (Tg) of the polyester resin is preferably from 50° C. to 80° C., and more preferably from 50° C. to 65° C.

The glass transition temperature is determined by a DSC curve obtained by differential scanning calorimetry (DSC). More specifically, the glass transition temperature is determined by "extrapolating glass transition starting temperature" disclosed in a method of determining the glass transition temperature of JIS K7121-1987 "Testing Methods for Transition Temperatures of Plastics".

A weight average molecular weight (Mw) of the polyester resin is preferably from 5,000 to 1,000,000, and more preferably from 7,000 to 500,000.

A number average molecular weight (Mn) of the polyester resin is preferably from 2,000 to 100,000.

A molecular weight distribution Mw/Mn of the polyester resin is preferably from 1.5 to 100, and more preferably from 2 to 60.

The weight average molecular weight and the number average molecular weight are measured by gel permeation chromatography (GPC). The molecular weight measurement by GPC is performed with a THF solvent using HLC-8120 GPC, a GPC manufactured by Tosoh Corporation as a measurement device and a TSKgel Super HM-M column (15 cm) manufactured by Tosoh Corporation. The weight average molecular weight and the number average molecular weight are calculated from results of this measurement using a calibration curve of molecular weights created with monodisperse polystyrene standard samples.

The polyester resin is obtained with a well-known production method. Specific examples thereof include a method of conducting a reaction at a polymerization temperature set to 180° C. to 230° C., if necessary, under reduced pressure in the reaction system, while removing water or alcohol generated during condensation.

When monomers of the raw materials do not dissolve or become compatibilized at a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with a major component.

A content of the binder resin is, for example, preferably from 40% by weight to 95% by weight, more preferably from 50% by weight to 90% by weight, and even more preferably from 60% by weight to 85% by weight, with respect to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

Among these, hydrocarbon wax (wax having hydrocarbon as a skeleton) is preferable as the release agent. The hydrocarbon wax is preferable since the release agent domain is easily formed and the hydrocarbon wax easily and rapidly bleeds to the surface of the toner particle at the time of fixation.

The melting temperature of the release agent is preferably from 50° C. to 110° C., and more preferably from 60° C. to 100° C.

The melting temperature of the release agent is obtained from "melting peak temperature" described in the method of obtaining a melting temperature in JIS K7121-1987 "Testing Methods for Transition Temperatures of Plastics", from a DSC curve obtained by differential scanning calorimetry (DSC).

As described above, in the exemplary embodiment, when the island portion configuring the peak including the maximum value a1 contains the first release agent and the island portion configuring the peak including the maximum value b1 contains the second release agent, the melting temperature of the first release agent is preferably higher than the melting temperature of the second release agent, from the viewpoint that it is possible to make the release agent in the toner particle more easily bleed by pressurization at the time of fixation and to form an image having more excellent bending resistance and abrasion resistance.

That is, the melting temperature of the release agent is preferably lower, as an area where the release agent is present is closer to the surface side of the toner particle.

At that time, the melting temperature of the first release agent is preferably in a range of 80° C. to 120° C. Meanwhile, the melting temperature of the second release agent is preferably a temperature lower than the melting temperature of the first release agent by 10° C. or more, and more preferably a temperature lower than the melting temperature of the first release agent by 15° C. or more.

The content of the release agent is, for example, preferably from 1% by weight to 20% by weight and more preferably from 5% by weight to 15% by weight with respect to the entirety of the toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

If necessary, the colorant may be surface-treated or used in combination with a dispersing agent. Plural kinds of colorants may be used in combination thereof.

The content of the colorant is, for example, preferably from 1% by weight to 30% by weight, and more preferably from 3% by weight to 15% by weight with respect to the entirety of the toner particles.

Other Additives

Examples of other additives include known additives such as a magnetic material, a charge-controlling agent, and an inorganic powder. The toner particles contain these additives as internal additives.

Characteristics of Toner Particle

The toner particle may be a toner particle having a single-layer structure or may be a toner particle having a so-called core/shell structure composed of a core (core particle) and a coating layer (shell layer) coated on the core.

Herein, the toner particle having a core/shell structure is, for example, preferably configured with a core having a sea-island structure including a sea portion containing the binder resin and an island portion containing the release agent, and a coating layer including the binder resin.

The volume average particle diameter (D50v) of the toner particles is preferably from 2 μm to 10 μm, and more preferably from 4 μm to 8 μm.

Various average particle diameters and various particle size distribution indices of the toner particles are measured using a Coulter Multisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle size ranges (channels)) separated based on the measured particle size distribution. The particle diameter when the cumulative percentage becomes 16% is defined as that corresponding to a volume particle diameter D16v and a number particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume particle diameter D84v and a number particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

A shape factor SF1 of the toner particles is preferably from 110 to 150, and more preferably from 120 to 140.

The shape factor SF1 is obtained through the following expression.

$$SF1=(ML^2/A)\times(7/4)\times100 \qquad \text{Expression:}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer Luzex through a video camera to obtain maximum lengths and projected areas of 100 particles, values of SF1 are calculated through the foregoing expression, and an average value thereof is obtained.

External Additives

Examples of the external additive include inorganic particles. Examples of the inorganic particles include $SiO_2$, $TiO_2$, $Al_2O_3$, CuO, ZnO, $SfO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Surfaces of the inorganic particles as an external additive are preferably subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

For the hydrophobizing treatment, hydrophobic silica particles such as dimethyl silicone oil-treated silica particles are preferably used.

Examples of the external additive also include resin particles (resin particles such as polystyrene, polymethylmethacrylate (PMMA), and melamine resin particles) and a cleaning aid (e.g., metal salt of a higher fatty acid represented by zinc stearate, and fluorine polymer particles).

The amount of the external additives externally added is, for example, preferably from 0.01% by weight to 5% by weight, and more preferably from 0.01% by weight to 2.0% by weight with respect to the toner particles.

Preparing Method of Toner

Next, a method of preparing a toner according to the exemplary embodiment will be described.

The toner according to the exemplary embodiment is obtained by externally adding an external additive to toner particles after preparing of the toner particles.

The toner particles may be prepared using any of a dry method (e.g., kneading and pulverizing method) and a wet method (e.g., aggregation and coalescence method, suspension and polymerization method, and dissolution and suspension method). The toner particle preparing method is not particularly limited to these preparing methods, and a known preparing method is employed.

Among these, the toner particles are preferably obtained by an aggregation and coalescence method.

Particularly, the toner particle is preferably prepared by an aggregation and coalescence method which will be described below, from the viewpoint of obtaining a toner (toner particle) satisfying the distribution characteristic of the degree of uneven distribution B of the release agent domain described above.

Hereinafter, the preparing method of the toner particle using the aggregation and coalescence method will be described with a specific example. In the following specific example, a preparing method of the toner particle having two maximum values of the distribution of the degree of uneven distribution B of the release agent domain and containing the colorant will be described, but there is no limitation thereto.

Specifically, the toner particle is preferably prepared through: a step of preparing each dispersion (dispersion preparation step); a step of mixing first resin particle dispersion in which first resin particles which are the binder resin are dispersed, and colorant particle dispersion in which particles of the colorant (hereinafter, also referred to as "colorant particles") are dispersed, with each other, aggregating each particle in the obtained mixed dispersion, and forming first aggregated particles (first aggregated particle forming step); a step of sequentially adding mixed dispersion in which second resin particles which are the binder resin and particles of a first release agent (hereinafter, also referred to as "first release agent particles") are dispersed to the first aggregated particle dispersion while slowly decreasing concentration of the first release agent particles in the mixed dispersion, after obtaining the first aggregated particle dispersion in which the first aggregated particles are dispersed, further aggregating the second resin particles and the first release agent particles on the surface of the first aggregated particles, and thereby forming second aggregated particles (second aggregated particle forming step); a step of sequentially adding mixed dispersion in which third resin particles which are the binder resin and particles of a second release agent (hereinafter, also referred to as "second release agent particles") are dispersed to the second aggregated particle dispersion while slowly decreasing concentration of the second release agent particles in the mixed dispersion, after obtaining the second aggregated particle dispersion in which the second aggregated particles are dispersed, further aggregating the third resin particles and the second release agent particles on the surface of the second aggregated particles, and thereby forming third aggregated particles (third aggregated particle forming step); and a step of heating the third aggregated particle dispersion in which the third aggregated particles are dispersed, to coalesce the third aggregated particles, and thereby forming toner particles (coalescence step).

The preparing method of the toner particle is not limited thereto.

For example, the resin particle dispersion and the colorant particle dispersion are mixed with each other, and each particle is aggregated in the obtained mixed dispersion. In the aggregation process, the release agent particle dispersion is added to the mixed dispersion while changing (increasing or decreasing) an addition speed or changing (increasing or decreasing) concentration of the release agent particles, the aggregation of each particle is further progressed, to form aggregated particles. The aggregated particles may be coalesced to form the toner particles.

In the method described above, after performing the step of forming the first aggregated particles, the first release agent dispersion, the second resin particle dispersion, the second release agent dispersion, and the third resin particle dispersion are added in this order to the first aggregated particle dispersion in which the first aggregated particles are dispersed, the aggregation of each particle is further progressed each time of the addition, to form aggregated particles. The aggregated particles may be coalesced to form the toner particles.

Hereinafter, each step (dispersion preparation step, first aggregated particle forming step, second aggregated particle forming step, third aggregated particle forming step, and coalescence step) will be described in detail.

Dispersion Preparation Step

First, each dispersion used in the aggregation and coalescence method is prepared.

Specifically, the first resin particle dispersion in which the first resin particles which are the binder resin are dispersed, the colorant particle dispersion in which the colorant particles are dispersed, the second resin particle dispersion in which the second resin particles which are the binder resin are dispersed, the first release agent particle dispersion in which the first release agent particles are dispersed, the third resin particle dispersion in which the third resin particles which are the binder resin are dispersed, and the second release agent particle dispersion in which the second release agent particles are dispersed, are prepared.

In each step, the first resin particles, the second resin particles, and the third resin particles are collectively described as the "resin particles". The first release agent particles and the second release agent particles are collectively described as the "release agent particles".

Herein, the resin particle dispersion is prepared by, for example, dispersing the resin particles by a surfactant in a dispersion medium.

Examples of the dispersion medium used for the resin particle dispersion include aqueous mediums.

Examples of the aqueous mediums include water such as distilled water and ion exchange water, and alcohol. These may be used alone or in combination of two or more kinds thereof.

Examples of the surfactant include anionic surfactants such as sulfate ester salt, sulfonate, phosphate, and soap anionic surfactants; cationic surfactants such as amine salt and quaternary ammonium salt cationic surfactants; and nonionic surfactants such as polyethylene glycol, alkylphenol ethylene oxide adduct, and polyol nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a Dyno Mill having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; performing neutralization by adding a base to an organic continuous phase (0 phase); and converting the resin (so-called phase inversion) from W/O to O/W by adding an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement with a laser diffraction-type particle size distribution measuring device (for example, manufactured by Horiba, Ltd., LA-700), and a particle diameter when the cumulative percentage becomes 50% with respect to the entirety of the particles is measured as a volume average particle diameter D50v. The volume average particle diameter of the particles in other dispersion is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion.

That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

First Aggregated Particle Forming Step

Next, the first resin particle dispersion and the colorant particle dispersion are mixed with each other.

The first resin particles and the colorant particles heterogeneously aggregate in the mixed dispersion, thereby forming first aggregated particles having a diameter of about 35%, for example, of a target toner particle diameter and including the first resin particles and the colorant particles.

The release agent is not contained in the first aggregated particles formed in this step.

Specifically, for example, an aggregating agent is added to the mixed dispersion and a pH of the mixed dispersion is adjusted to acidity (for example, the pH being from 2 to 5). If necessary, a dispersion stabilizer is added. Then, the mixed dispersion is heated at a temperature close to the glass transition temperature of the first resin particles (specifically, for example, from a temperature 30° C. lower than the glass transition temperature of the first resin particles to a temperature 10° C. lower than the glass transition temperature thereof) to aggregate the particles dispersed in the mixed dispersion, thereby forming the first aggregated particles.

In the first aggregated particle forming step, for example, the aggregating agent may be added at room temperature (for example, 25° C.) under stirring of the mixed dispersion using a rotary shearing-type homogenizer, the pH of the mixed dispersion may be adjusted to acidity (for example, the pH being from 2 to 5), a dispersion stabilizer may be added if necessary, and the heating may then be performed.

Examples of the aggregating agent include a surfactant having an opposite polarity to the polarity of the surfactant used as the dispersing agent added to the mixed dispersion, such as inorganic metal salts and di- or higher-valent metal complexes. Particularly, when a metal complex is used as the aggregating agent, the amount of the surfactant used is reduced and charging characteristics are improved.

If necessary, an additive may be used which forms a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Specific examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA). The amount of the chelating agent added is, for example, preferably from 0.01 parts by weight to 5.0 parts by weight, and more preferably from 0.1 parts by weight to less than 3.0 parts by weight with respect to 100 parts by weight of the first resin particles.

Second Aggregated Particle Forming Step

After obtaining the first aggregated particle dispersion in which the first aggregated particles are dispersed as described above, the mixed dispersion in which the second resin particles which are the binder resin and the first release agent particles are dispersed, is sequentially added to the first aggregated particle dispersion while slowly decreasing the concentration of the first release particles in the mixed dispersion.

The second resin particles may be the same kind as that of the first resin particles or may be different kinds from that of the first resin particles.

The second resin particles and the first release agent particles are aggregated on the surface of the first aggregated particles, in the dispersion in which the first aggregated particles, the second resin particles, and the first release agent particles are dispersed.

Specifically, for example, in the first aggregated particle forming step, when the particle diameter of the first aggregated particles achieves the desired particle diameter, the mixed dispersion in which the second resin particles and the first release agent particles are dispersed, is sequentially added to the first aggregated particle dispersion while slowly decreasing the concentration of the first release agent particles, and the dispersion is heated at a temperature equal to or lower than the glass transition temperature of the second resin particle.

By performing this step, the aggregated particles in which the second resin particles and the first release agent particles are adhered to the surface of the first aggregated particles are formed. That is, the second aggregated particles in which an aggregated material of the second resin particles and the first release agent particles are adhered to the surface of the first aggregated particles are formed.

In this step, since such a mixed dispersion is sequentially added to the first aggregated particle dispersion, while slowly decreasing the concentration of the first release agent particles in the mixed dispersion in which the second resin particles and the first release agent particles are dispersed, the aggregated material of the second resin particles and the first release agent particles, of which the concentration (presence ratio) of the first release agent particles changes from high to low towards the outer side in the particle diameter direction, is adhered to the surface of the first aggregated particles.

In the second aggregated particle forming step, a speed and an amount of decrease in the concentration of the first release agent in the mixed dispersion may be set to be matched with the desired distribution characteristics of the degree of uneven distribution B of the release agent domain.

Third Aggregated Particle Forming Step

As described above, the mixed dispersion in which the third resin particles which are the binder resin and the second release agent particles are dispersed, is sequentially added to the second aggregated particle dispersion while slowly decreasing the concentration of the second release agent particles in the mixed dispersion, after obtaining the second aggregated particle dispersion in which the second aggregated particles are dispersed.

The third resin particles may be the same kind as that of the first resin particles and the second resin particles or may be different kinds from that of the first resin particles and the second resin particles. In addition, the second release agent particles may be the same kind as that of the first release agent particles or may be different kinds from that of the first release agent particles.

The third resin particles and the second release agent particles are aggregated on the surface of the second aggregated particles, in the dispersion in which the second aggregated particles, the third resin particles, and the second release agent particles are dispersed.

Specifically, for example, in the second aggregated particle forming step, when the particle diameter of the second aggregated particles achieves the desired particle diameter, the mixed dispersion in which the third resin particles and the first release agent particles are dispersed, is sequentially added to the second aggregated particle dispersion while slowly decreasing the concentration of the second release agent particles, and the dispersion is heated at a temperature equal to or lower than the glass transition temperature of the third resin particle.

The progress of aggregating is stopped by setting the pH of the dispersion in a range of, approximately, 6.5 to 8.5, for example.

By performing this step, the aggregated particles in which the third resin particles and the second release agent particles are adhered to the surface of the second aggregated particles are formed. That is, the third aggregated particles in which an aggregated material of the third resin particles and the second release agent particles are adhered to the surface of the second aggregated particles are formed.

In this step, since such a mixed dispersion is sequentially added to the first aggregated particle dispersion, while slowly decreasing the concentration of the second release agent particles in the mixed dispersion in which the third resin particles and the second release agent particles are dispersed, the aggregated material of the third resin particles and the second release agent particles, of which the concentration (presence ratio) of the second release agent particles changes from high to low towards the outer side in the particle diameter direction, is adhered to the surface of the first aggregated particles.

In the third aggregated particle forming step, a speed and an amount of decrease in the concentration of the second release agent in the mixed dispersion may be set to be matched with the desired distribution characteristics of the degree of uneven distribution B of the release agent domain.

As the addition method of the mixed dispersion in the second aggregated particle forming step and the third aggregated particle forming step, a power feed addition method may be preferably used.

By using the power feed addition method, it is possible to slowly decrease the concentration of the release agent particles in the mixed dispersion and to add the mixed dispersion sequentially to the aggregated particle dispersion.

Hereinafter, the addition method of the mixed dispersion using the power feed addition method in the second aggregated particle forming step will be described with reference to the drawing.

Figure 3:
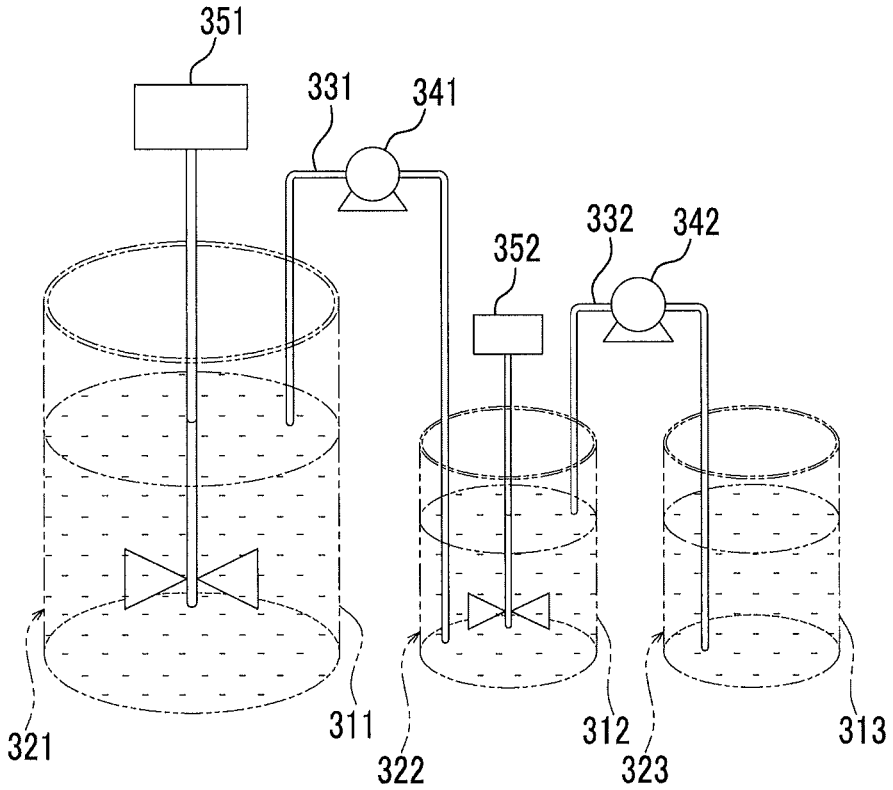
FIG. 3 is a schematic view illustrating a power feed addition method.

FIG. 3 shows an apparatus used for the power feed addition method.

The apparatus shown in FIG. 3 includes a first accommodation tank 321, a second accommodation tank 322, and a third accommodation tank 323, each of which accommodates dispersion.

In the apparatus shown in FIG. 3, in a state before driving a first liquid delivery pump 341 and a second liquid delivery pump 342, dispersion accommodated in the first accommodation tank 321 is the first aggregated particle dispersion in which the first aggregated particles are dispersed, dispersion accommodated in the second accommodation tank 322 is the first release agent particle dispersion in which the first release agent particles are dispersed, and dispersion accommodated in the third accommodation tank 323 is the second resin particle dispersion in which the second resin particles are dispersed.

The first accommodation tank 321 and the second accommodation tank 322 are connected to each other through a first liquid delivery tube 331. The first liquid delivery pump 341 is provided in the middle of a path of the first liquid delivery tube 331. By driving the first liquid delivery pump 341, the dispersion accommodated in the second accommodation tank 322 is delivered to the first accommodation tank 321 through the first liquid delivery tube 331.

A first stirring device 351 is disposed in the first accommodation tank 321. By driving the first stirring device 351, the dispersion delivered from the second accommodation tank 322 is stirred and mixed with the dispersion accommodated in the first accommodation tank 321, in the first accommodation tank 321.

The second accommodation tank 322 and the third accommodation tank 323 are connected to each other through the second liquid delivery tube 332. The second liquid delivery pump 342 is provided in the middle of a path of the second liquid delivery tube 332. By driving the second liquid delivery pump 342, the dispersion accommodated in the third accommodation tank 323 is delivered to the second accommodation tank 322 through the second liquid delivery tube 332.

A second stirring device 352 is disposed in the second accommodation tank 322. By driving the second stirring device 352, the dispersion delivered from the third accommodation tank 323 is stirred and mixed with the dispersion accommodated in the second accommodation tank 322, in the second accommodation tank 322.

Next, the operation of the apparatus shown in FIG. 3 will be described.

In the apparatus shown in FIG. 3, first, the first aggregated particle dispersion is accommodated in the first accommodation tank 321.

The first aggregated particle dispersion accommodated in the first accommodation tank 321 may be prepared by performing the first aggregated particle forming step in the first accommodation tank 321. After preparing the first aggregated particle dispersion by performing the first aggregated particle forming step in another tank, the first aggregated particle dispersion may be accommodated in the first accommodation tank 321.

The release agent particle dispersion is accommodated in the second accommodation tank 322 and the second resin particle dispersion is accommodated in the third accommodation tank 323.

In this state, the first liquid delivery pump 341 and the second liquid delivery pump 342 are driven.

By this driving, the dispersion accommodated in the second accommodation tank 322 is delivered to the first accommodation tank 321. By driving the first stirring device 351, each dispersion is stirred and mixed in the first accommodation tank 321.

Meanwhile, the dispersion accommodated in the third accommodation tank 323 is delivered to the second accommodation tank 322. By driving the second stirring device 352, each dispersion is stirred and mixed in the second accommodation tank 322.

At that time, by driving the second liquid delivery pump 342, the second resin particle dispersion accommodated in the third accommodation tank 323 is sequentially delivered to the second accommodation tank 322, and the second resin particle dispersion is mixed with the release agent particle dispersion previously accommodated in the second accommodation tank 322. Accordingly, the mixed dispersion in which the second resin particle dispersion is mixed with the release agent particle dispersion, is accommodated in the second accommodation tank 322. By sequentially delivering the second resin particle dispersion to the second accommodation tank 322, the concentration of the release agent particles in the mixed dispersion is slowly decreased.

The mixed dispersion accommodated in the second accommodation tank 322 is delivered to the first accommodation tank 321 and is mixed with the first aggregated particle dispersion.

As described above, the mixed dispersion accommodated in the second accommodation tank 322 is continuously delivered to the first accommodation tank 321 while slowly decreasing the concentration of the release agent particle dispersion in the mixed dispersion.

As described above, by using the power feed addition method, it is possible to add the mixed dispersion in which the second resin particles and the release agent particles are dispersed to the first aggregated particle dispersion, while slowly decreasing the concentration of the release agent particles.

In the power feed addition method, the distribution characteristic of the degree of uneven distribution B of the release agent domain are adjusted by adjusting the liquid delivery start time and the liquid delivery speed of each dispersion accommodated in the second accommodation tank 322 and the third accommodation tank 323. In the power feed addition method, the distribution characteristic of the degree of uneven distribution B of the release agent domain are adjusted by adjusting the liquid delivery speed in delivering each dispersion accommodated in the second accommodation tank 322 and the third accommodation tank 323.

Specifically, for example, the maximum values of the distribution of the degree of uneven distribution B of the release agent domain are adjusted by the liquid delivery start time of the release agent particle dispersion accommodated in the second accommodation tank 322 to the first accommodation tank 321.

In a case of the second aggregated particle forming step, the dispersion accommodated in the second accommodation tank 322 may preferably be delivered to the first accommodation tank 321, before the time when the delivery of the second resin particle dispersion is started from the third accommodation tank 323 to the second accommodation tank 322 or immediately after the delivery thereof is started. Accordingly, only the first release agent particle dispersion or the mixed dispersion of the small amount of the second resin particle dispersion and the first release agent particle dispersion is delivered from the second accommodation tank 322 to the first accommodation tank 321. By performing the delivery, the aggregated material having high concentration (presence ratio) of the first release agent particles is formed on the surface of the first aggregated particles. An area of the aggregated material having high concentration (presence ratio) of the first release agent particles is the first maximum value, when the toner particles are obtained.

After that, as the delivery is continued, the concentration of the first release agent particles in the mixed dispersion delivered to the first accommodation tank 321 is slowly decreased.

In a case of using the addition method of the mixed dispersion using the power feed addition method in the third aggregated particle forming step, an apparatus in which, in a state before driving the first liquid delivery pump 341 and a second liquid delivery pump 342, the second aggregated particle dispersion is accommodated in the first accommodation tank 321, the second release agent particle dispersion is accommodated in the second accommodation tank 322, and the third resin particle dispersion is accommodated in the third accommodation tank 323, respectively, may be used.

By performing the driving (delivering) using such an apparatus as described above, the aggregated material having high concentration (presence ratio) of the second release agent particles is formed on the surface of the second aggregated particle, and the area thereof is the second maximum value, when the toner particles are obtained.

The power feed method described above is not limited to the method described above.

Various methods may be used, for example, 1) a method including separately providing an accommodation tank accommodating the second resin particle dispersion and an accommodation tank accommodating the mixed dispersion in which the second resin particles and the first release agent particles are dispersed, and delivering each dispersion from each accommodation tank to the first accommodation tank 321 while changing the liquid delivery speed, or 2) a method including separately providing an accommodation tank accommodating the first release agent particle dispersion and an accommodation tank accommodating the mixed dispersion in which the second resin particles and the first release agent particles are dispersed, and delivering each dispersion from each accommodation tank to the first accommodation tank 321 while changing the liquid delivery speed.

The third aggregated particles are formed through the second aggregated particle forming step and the third aggregated particle forming step.

By performing the same steps as the second aggregated particle forming step and the third aggregated particle forming step, it is possible to obtain the toner particle having three or more maximum values of the distribution of the degree of uneven distribution B of the release agent domain.

Coalescence Step

Next, the third aggregated particle dispersion in which the third aggregated particles are dispersed is heated at, for example, a temperature that is equal to or higher than the glass transition temperature of the first, second, and third resin particles (for example, a temperature that is higher than the glass transition temperature of the first, second, and third resin particles by 10° C. to 30° C.) to coalesce the third aggregated particles and form toner particles.

By performing the above steps, the toner particles are obtained.

The toner particles may be prepared through: a step of further mixing, after obtaining the aggregated particle dispersion in which the third aggregated particles are dispersed, the third aggregated particle dispersion and a fourth resin particle dispersion in which fourth resin particles which are the binder resin are dispersed, aggregating the fourth resin particles so as to further adhere the particles to the surface of the third aggregated particles, and forming fourth aggregated particles, and a step of heating a fourth aggregated particle dispersion in which the fourth aggregated particles are dispersed, to coalesce the fourth aggregated particles, and forming toner particles having the core/shell structure.

By performing this operation, in the obtained toner particle, the maximum value of distribution of the degree of uneven distribution B of the release agent domain is smaller than 1.00 due to the presence of the shell layer not containing the release agent.

Herein, after the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, but freeze drying, flash jet drying, fluidized drying, vibration-type fluidized drying, or the like is preferably performed from the viewpoint of productivity.

The toner according to the exemplary embodiment is prepared by, for example, adding and mixing an external additive to and with dry toner particles that have been obtained.

The mixing is preferably performed with, for example, a V-blender, a Henschel mixer, a Lodige mixer, or the like. Furthermore, if necessary, coarse toner particles may be removed using a vibration sieving machine, a wind classifier, or the like.

Electrostatic Charge Image Developer

An electrostatic charge image developer according to the exemplary embodiment includes at least the toner according to the exemplary embodiment.

The electrostatic charge image developer according to the exemplary embodiment may be a single-component developer including only the toner according to the exemplary embodiment, or a two-component developer obtained by mixing the toner with a carrier.

The carrier is not particularly limited, and known carriers are exemplified. Examples of the carrier include a coated carrier in which surfaces of cores formed of magnetic particles are coated with a coating resin; a magnetic particle dispersion-type carrier in which a magnetic particle is dispersed in and blended into a matrix resin; and a resin impregnation-type carrier in which a porous magnetic particle is impregnated with a resin.

The magnetic particle dispersion-type carrier and the resin impregnation-type carrier may be carriers in which constituent particles of the carrier are cores and have a surface coated with a coating resin.

Examples of the magnetic particle include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain additives such as a conductive particle.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles, and preferably carbon black particles are used.

Herein, a coating method using a coating layer forming solution in which a coating resin and, if necessary, various additives are dissolved in an appropriate solvent is used to coat the surface of a core with the coating resin. The solvent is not particularly limited, and may be selected in consideration of the type of coating resin to be used, coating suitability, and the like.

Specific examples of the resin coating method include a dipping method of dipping cores in a coating layer forming solution; a spraying method of spraying a coating layer forming solution onto surfaces of cores; a fluid bed method of spraying a coating layer forming solution in a state in which cores are allowed to float by flowing air; and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method

An image forming apparatus and an image forming method according to the exemplary embodiment will be described.

The image forming apparatus according to the exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to the exemplary embodiment is applied.

In the image forming apparatus according to the exemplary embodiment, an image forming method (image forming method according to the exemplary embodiment) including a charging process of charging a surface of an image holding member, an electrostatic charge image forming step of forming an electrostatic charge image on the charged surface of the image holding member, a developing step of developing the electrostatic charge image formed on the surface of the image holding member with the electrostatic charge image developer according to the exemplary embodiment to form a toner image, a transfer process of transferring the toner image formed on the surface of the image holding member onto a surface of a recording medium, and a fixing process of fixing the toner image transferred onto the surface of the recording medium is performed.

As the image forming apparatus according to the exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus including a cleaning unit that cleans the surface of the image holding member after transfer of the toner image and before charging; and an apparatus including an erasing unit that performs erasing by irradiating the surface of the image holding member with erasing light, after transfer of the toner image and before charging.

In the case where the image forming apparatus according to the exemplary embodiment is an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to the exemplary embodiment, for example, a part including the developing unit may have a cartridge structure (process cartridge) that is detachable from the image forming apparatus. As the process cartridge, for example, a process cartridge that is provided with a developing unit that contains the electrostatic charge image developer according to the exemplary embodiment is preferably used.

Hereinafter, an example of the image forming apparatus according to the exemplary embodiment will be described. However, the image forming apparatus is not limited thereto. The major parts shown in the drawing will be described, and descriptions of other parts will be omitted.

FIG. 1 is a schematic configuration diagram showing the image forming apparatus according to the exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the right and left sides in the drawing, and travels in a direction toward the fourth unit 10K from the first unit 10Y. To the support roll 24, a force is applied in a direction in which it departs from the driving roll 22 by a spring or the like (not shown), and tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toners including four colors of toner, that is, a yellow toner, a magenta toner, a cyan toner, and a black toner contained in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias suppliers (not shown) that apply a primary transfer bias are connected to the primary transfer rolls 5Y, 5M, 5C, and 5K, respectively. Each bias supplier changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same resistance as that of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1*y*, whereby an electrostatic charge image of a yellow image pattern is formed on the surface of the photoreceptor 1Y.

The electrostatic charge image is an image that is formed on the surface of the photoreceptor 1*y* by charging, and is a so-called negative latent image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y contains, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the latent image part having been erased on the surface of the photoreceptor 1Y, whereby the latent image is developed with the yellow toner. Next, the photoreceptor 1Y having the yellow toner image formed thereon continuously travels at a predetermined speed and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to be +10 μA in the first unit 10Y by the controller (not shown).

Meanwhile, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 100, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copiers, printers, and the like. Among these, plain paper of cardboard is preferable, in a viewpoint of production of effect of the toner according to the exemplary embodiment. As a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations ends.

Process Cartridge/Toner Cartridge

A process cartridge according to the exemplary embodiment will be described.

The process cartridge according to the exemplary embodiment is provided with a developing unit that contains the electrostatic charge image developer according to the exemplary embodiment and develops an electrostatic charge image formed on a surface of an image holding member with the electrostatic charge image developer to form a toner image, and is detachable from an image forming apparatus.

The process cartridge according to the exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to the exemplary embodiment will be illustrated. However, the process cartridge is not limited thereto. Major parts shown in the drawing will be described, and descriptions of other parts will be omitted.

Figure 2:
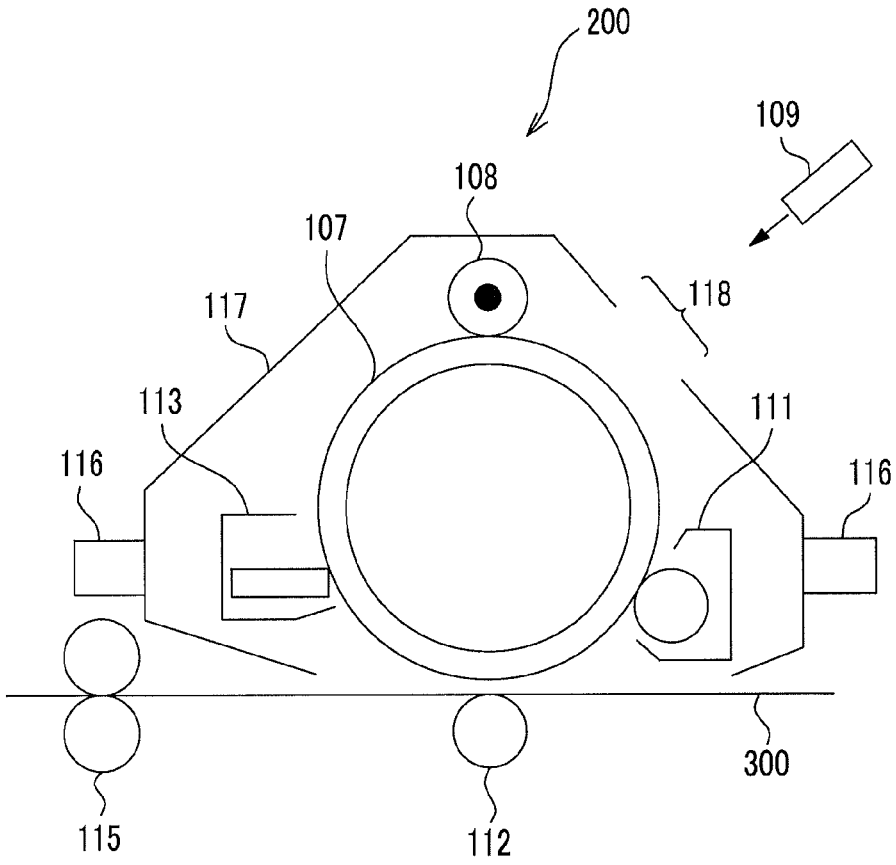
FIG. 2 is a schematic configuration diagram showing an example of a process cartridge according to the exemplary embodiment.

FIG. 2 is a schematic diagram showing a configuration of the process cartridge according to the exemplary embodiment.

A process cartridge 200 shown in FIG. 2 is formed as a cartridge having a configuration in which a photoreceptor 107 (an example of the image holding member), and a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to the exemplary embodiment will be described.

The toner cartridge according to the exemplary embodiment contains the toner according to the exemplary embodiment and is detachable from an image forming apparatus. The toner cartridge contains a toner for replenishment to be supplied to the developing unit provided in the image forming apparatus.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, when the toner contained in the toner cartridge runs low, the toner cartridge is replaced.

EXAMPLES

Hereinafter, the exemplary embodiment will be described in more detail using examples and comparative examples, but is not limited to these examples. Unless otherwise noted, "parts" are based on "parts by weight".

Preparation of Resin Particle Dispersion

Preparation of Resin Particle Dispersion (1)

Terephthalic acid: 30 parts by mole

Fumaric acid: 70 parts by mole

Ethylene oxide adduct of bisphenol A: 5 parts by mole

Propylene oxide adduct of bisphenol A: 95 parts by mole

The above materials are added into a 5-liter flask including a stirrer, a nitrogen gas introducing tube, a temperature sensor, and a rectifier, and are heated to a temperature of 210° C. for 1 hour, and 1 part of titanium tetraethoxide is added to 100 parts of the sample. The temperature is increased to 230° C. for 0.5 hours while distilling away the generated water, dehydration condensation reaction is further continued at the temperature for 1 hour, and then the reactant is cooled. As described above, a polyester resin (1) having a weight average molecular weight of 18,500, an acid value of 14 mg KOH/g, and a glass transition temperature of 59° C. is synthesized.

After adding 40 parts of ethyl acetate and 25 parts of 2-butanol to a container including a temperature adjustment unit and a nitrogen substitution unit, to obtain a mixed solution, 100 parts of the polyester resin (1) is slowly added to and dissolved in the mixed solution, 10% by weight ammonia aqueous solution (amount corresponding to three times in a molar ratio with respect to acid value of the resin) is added thereto and stirred for 30 minutes.

Next, the gas in the container is substituted with dry nitrogen, the temperature is maintained at 40° C., 400 parts of ion exchange water is dropwise added at a rate of 2 parts/min while stirring the mixture, and emulsification is performed. After completing the dropwise addition, the temperature of the emulsified solution is returned to a room temperature (20° C. to 25° C.), bubbling is performed for 48 hours by the dry nitrogen while stirring, and accordingly, ethyl acetate and 2-butanol are decreased to 1,000 ppm or less, and resin particle dispersion in which resin particles having a volume average particle diameter of 200 nm is obtained. The ion exchange water is added to the resin particle dispersion, the solid content is adjusted to 20% by weight, and the resin particle dispersion (1) is obtained.

Preparation of Colorant Particle Dispersion

Preparation of Colorant Particle Dispersion (1)

Cyan pigment C.I. Pigment Blue 15:3:70 parts (copper phthalocyanine manufactured by DIC, product name: FASTOGEN BLUE LA5380)

Anionic surfactant (NEOGEN RK manufactured by Dai-Ichi Kogyo Seiyaku Co., Ltd.): 5 parts Ion exchange water: 200 parts The above materials are mixed with each other and dispersed using a homogenizer (Ultra Turrax T50 manufactured by IKA Japan, K.K.) for 10 minutes. The ion exchange water is added so that the solid content in the dispersion becomes 20% by weight, and colorant particle dispersion (1) in which the colorant particles having a volume average particle diameter of 190 nm are dispersed, is obtained.

Preparation of Release Agent Particle Dispersion

Preparation of Release Agent Particle Dispersion (1)

Paraffin Wax: 100 parts (HNP-9 manufactured by Nippon Seiro Co., Ltd., melting temperature: 75° C.)

Anionic surfactant (NEOGEN RK manufactured by Dai-Ichi Kogyo Seiyaku Co., Ltd.): 1 part Ion exchange water: 350 parts The materials are mixed with each other, heated at 100° C., and dispersed using a homogenizer (Ultra Turrax T50 manufactured by IKA Japan, K.K.). After that, the mixture is subject to dispersion treatment with Manton-Gaulin high pressure homogenizer (manufactured by Gaulin Co., Ltd.), and release agent particle dispersion (1) (solid content of 20% by weight) in which release agent particles having a volume average particle diameter of 200 nm are dispersed, is obtained.

Preparation of Release Agent Particle Dispersion (2)

Polyethylene wax: 100 parts (POLYWAX 750 manufactured by Baker Petrolite Corporation, melting temperature of 104° C.)

Anionic surfactant (NEOGEN RK manufactured by Dai-Ichi Kogyo Seiyaku Co., Ltd.): 1 part Ion exchange water: 350 parts The materials are mixed with each other, heated at 100° C., and dispersed using a homogenizer (Ultra Turrax T50 manufactured by IKA Japan, K.K.). After that, the mixture is subject to dispersion treatment with Manton-Gaulin high pressure homogenizer (manufactured by Gaulin Co., Ltd.), and release agent particle dispersion (2) (solid content of 20% by weight) in which release agent particles having a volume average particle diameter of 200 nm are dispersed, is obtained.

Example 1

Preparation of Toner Particles

Figure 4:
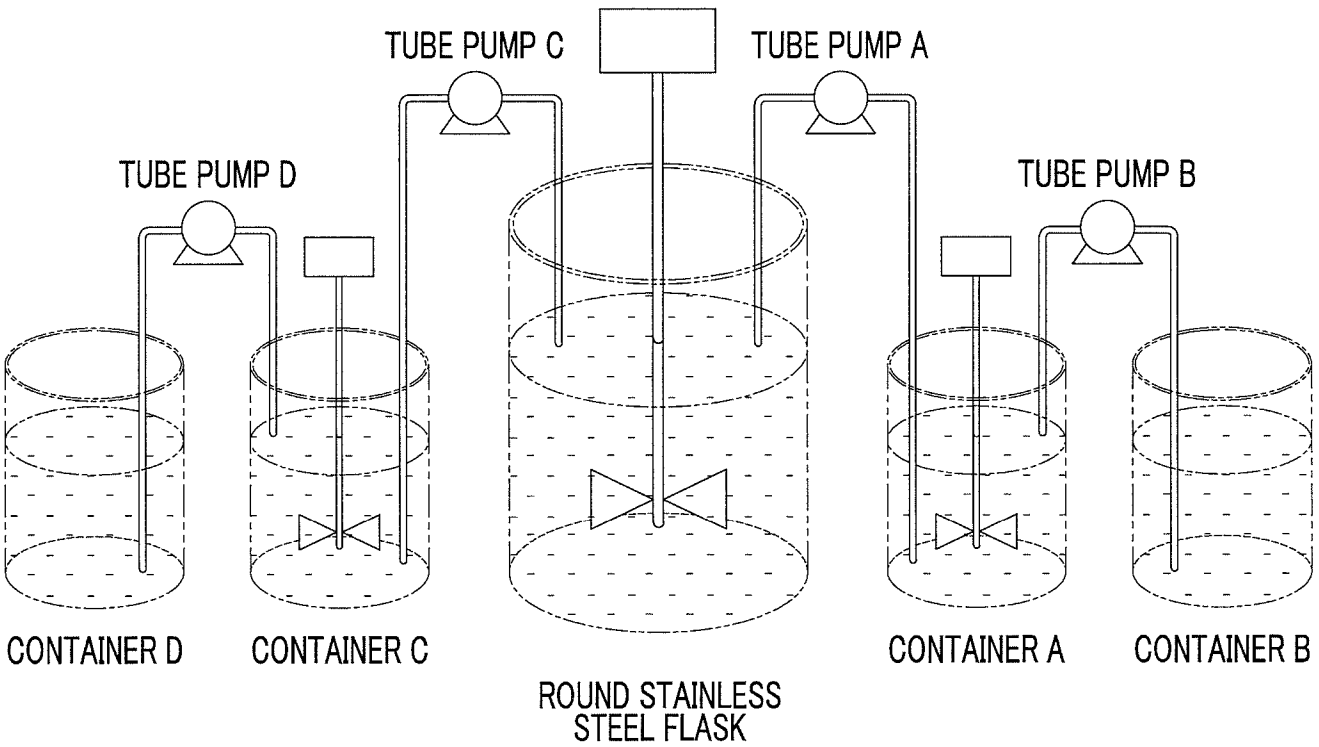
FIG. 4 is a schematic view illustrating an apparatus used for the power feed addition method used in Example 1.

An apparatus shown in FIG. 4 is prepared by applying the apparatus used in the power feed addition method shown in FIG. 3.

The apparatus shown in FIG. 4 performs the first power feed addition method on the right side including the round stainless steel flask and performs the second power feed addition method on the left side including the round stainless steel flask.

In a portion where the first power feed addition method is performed, the round stainless steel flask and a container A are connected to each other through a tube pump A, accommodation liquid which is accommodated in the container A is delivered to the flask by driving the tube pump A, the container A and a container B are connected to each other through a tube pump B, and accommodation liquid which is accommodated in the container B is delivered to the container A by driving the tube pump B.

In a portion where the second power feed addition method is performed, the round stainless steel flask and a container C are connected to each other through a tube pump C, accommodation liquid which is accommodated in the container C is delivered to the flask by driving the tube pump C, the container C and a container D are connected to each other through a tube pump D, and accommodation liquid which is accommodated in the container D is delivered to the container C by driving the tube pump D.

Each of the accommodation liquid which is accommodated in the container A, the container C, and the round stainless steel flask is stirred by a stirring device.

The following operation is performed using the apparatus shown in FIG. 4.

Resin particle dispersion (1): 53.1 parts

Colorant particle dispersion (1): 25 parts

Anionic surfactant (TaycaPower): 2 parts

The above materials are added to the round stainless steel flask, 0.1 N of nitric acid is added to adjust the pH to 3.5, and then, 30 parts of aqueous nitric acid having polyaluminum chloride concentration of 10% by weight, is added. Then, after dispersing the resultant material at 30° C. using a homogenizer (Ultra Turrax T50 manufactured by IKA Japan, K.K.), a particle diameter of the first aggregated particles is grown while increasing the temperature at pace of 1° C./30 min in a heating oil bath.

Meanwhile, 12.5 parts of the release agent particle dispersion (2) is added to the container A which is polyester bottle, and in the same manner, 207.9 parts of the resin particle dispersion (1) is added to the container B which is polyester bottle. Next, the liquid delivery speed of the tube pump A is set as 3 parts/1 min and the liquid delivery speed of the tube pump B is set as 6 parts/1 min, the internal temperature of the round stainless steel flask in which the first aggregated particle is being formed is increased at 1° C./min, the increase in temperature is stopped when the particle diameter of the first aggregated particle becomes 2.9 μm, the tube pumps A and B are simultaneously driven, and each dispersion is delivered.

The dispersion is maintained while stirring for 30 minutes, from the time when the delivering of each dispersion to the flask is completed, and the second aggregated particles are formed.

Next, 37.5 parts of the release agent particle dispersion (1) is added to the container C which is the polyester bottle, and in the same manner as described above, 164.0 parts of the resin particle dispersion (1) is added to the container D which is the polyester bottle. Next, the liquid delivery speed of the tube pump C is set as 9 parts/1 min and the liquid delivery speed of the tube pump D is set as 6 parts/1 min, the tube pumps C and D are simultaneously driven, and each dispersion is delivered.

After completing the delivery of each dispersion to the flask, the temperature is increased by 1° C. and maintained while stirring for 30 minutes, and the third aggregated particles are formed.

After that, after adjusting the pH to 8.5 by adding 0.1 N sodium hydroxide aqueous solution, the temperature is increased to 85° C. while continuing the stirring, and maintained for 5 hours. Then, the temperature is decreased to 20° C. at a rate of 20° C./min, the resultant material is filtered, sufficiently washed with ion exchange water, and dried, to obtain toner particles (1) having a volume average particle diameter of 6.0 μm.

Preparation of Toner 100 parts of the toner particles (1) and 0.7 parts of dimethyl silicone oil-treated silica particles (RY 200 manufactured by Nippon Aerosil co., Ltd.) are mixed with each other using a Henschel mixer, and toner (1) is obtained.

Preparation of Developer

Ferrite particles (average particle diameter of 50 μm) 100 parts

Toluene: 14 parts

Styrene-methyl methacrylate copolymer (copolymerization ratio of 15/85): 3 parts Carbon black: 0.2 parts The above components excluding the ferrite particles are dispersed by a sand mill to prepare dispersion, this dispersion and the ferrite particles are added into a vacuum degassing type kneader, dried while stirring under the reduced pressure, and thereby a carrier is obtained.

8 parts of the toner (1) is mixed with 100 parts of the carrier, and a developer (1) is obtained.

Example 2

Toner particles (2) are obtained in the same manner as in Example 1, except for changing the amount of the resin particle dispersion (1) added to the initial round stainless steel flask to 21.5 parts, the amount of the release agent particle dispersion (2) added to the container A to 10.0 parts, the amount of the resin particle dispersion (1) added to the container B to 172.5 parts, the amount of the release agent particle dispersion (1) added to the container C to 40.0 parts, and the amount of the resin particle dispersion (1) added to the container D to 231.0 parts respectively in the preparation of the toner particles (1).

The obtained toner particle (2) has a volume average particle diameter of 6.0 μm.

Toner (2) and a developer (2) are obtained using the toner particles (2), in the same manner as in Example 1.

Example 3

Toner particles (3) are obtained in the same manner as in Example 1, except for changing the amount of the resin particle dispersion (1) added to the initial round stainless steel flask to 21.5 parts, the amount of the release agent particle dispersion (2) added to the container A to 15.0 parts, the amount of the resin particle dispersion (1) added to the container B to 342.9 parts, the amount of the release agent particle dispersion (1) added to the container C to 35.0 parts, and the amount of the resin particle dispersion (1) added to the container D to 60.6 parts respectively in the preparation of the toner particles (1).

The obtained toner particle (3) has a volume average particle diameter of 5.9 μm.

Toner (3) and a developer (3) are obtained using the toner particles (3), in the same manner as in Example 1.

Example 4

Toner particles (4) are obtained in the same manner as in Example 1, except for changing the amount of the resin particle dispersion (1) added to the initial round stainless steel flask to 111.4 parts, the amount of the release agent particle dispersion (2) added to the container A to 8.0 parts, the amount of the resin particle dispersion (1) added to the container B to 82.6 parts, the amount of the release agent particle dispersion (1) added to the container C to 42.0 parts, and the amount of the resin particle dispersion (1) added to the container D to 231.0 parts respectively in the preparation of the toner particles (1).

The obtained toner particle (4) has a volume average particle diameter of 6.1 μm.

Toner (4) and a developer (4) are obtained using the toner particles (4), in the same manner as in Example 1.

Example 5

Toner particles (5) are obtained in the same manner as in Example 1, except for changing the amount of the resin particle dispersion (1) added to the initial round stainless steel flask to 111.4 parts, the amount of the release agent particle dispersion (2) added to the container A to 18.5 parts, the amount of the resin particle dispersion (1) added to the container B to 253.0 parts, the amount of the release agent particle dispersion (1) added to the container C to 31.5 parts, and the amount of the resin particle dispersion (1) added to the container D to 60.6 parts respectively in the preparation of the toner particles (1).

The obtained toner particle (5) has a volume average particle diameter of 6.0 μm.

Toner (5) and a developer (5) are obtained using the toner particles (5), in the same manner as in Example 1.

Example 6

Toner particles (6) are obtained in the same manner as in Example 1, except for changing the amount of the resin particle dispersion (1) added to the initial round stainless steel flask to 21.5 parts, the amount of the release agent particle dispersion (2) added to the container A to 12.5 parts, the amount of the resin particle dispersion (1) added to the container B to 124.2 parts, the amount of the release agent particle dispersion (1) added to the container C to 37.5 parts, and the amount of the resin particle dispersion (1) added to the container D to 279.2 parts respectively in the preparation of the toner particles (1).

The obtained toner particle (6) has a volume average particle diameter of 6.0 μm.

Toner (6) and a developer (6) are obtained using the toner particles (6), in the same manner as in Example 1.

Example 7

Toner particles (7) are obtained in the same manner as in Example 1, except for changing the amount of the resin particle dispersion (1) added to the initial round stainless steel flask to 145.8 parts, the amount of the release agent particle dispersion (2) added to the container A to 12.5 parts, the amount of the resin particle dispersion (1) added to the container B to 115.2 parts, the amount of the release agent particle dispersion (1) added to the container C to 37.5 parts, and the amount of the resin particle dispersion (1) added to the container D to 164.0 parts respectively in the preparation of the toner particles (1).

The obtained toner particle (7) has a volume average particle diameter of 6.0 μm.

Toner (7) and a developer (7) are obtained using the toner particles (7), in the same manner as in Example 1.

Example 8

Toner particles (8) are obtained in the same manner as in Example 1, except for changing the amount of the resin particle dispersion (1) added to the initial round stainless steel flask to 11.5 parts, the amount of the release agent particle dispersion (2) added to the container A to 12.5 parts, the amount of the resin particle dispersion (1) added to the container B to 352.9 parts, the amount of the release agent particle dispersion (1) added to the container C to 37.5 parts, and the amount of the resin particle dispersion (1) added to the container D to 60.6 parts respectively in the preparation of the toner particles (1).

The obtained toner particle (8) has a volume average particle diameter of 6.0 μm.

Toner (8) and a developer (8) are obtained using the toner particles (8), in the same manner as in Example 1.

Example 9

Toner particles (9) are obtained in the same manner as in Example 1, except for changing the release agent particle dispersion (2) added to the container A to the release agent particle dispersion (1), in the preparation of the toner particles (1).

The obtained toner particle (9) has a volume average particle diameter of 6.0 μm.

Toner (9) and a developer (9) are obtained using the toner particles (9), in the same manner as in Example 1.

Comparative Example 1

Toner particles (C1) are obtained in the same manner as in Example 1, except for changing the amount of the resin particle dispersion (1) added to the initial round stainless steel flask to 261.0 parts, the amount of the release agent particle dispersion (2) added to the container A to 50 parts, and the amount of the resin particle dispersion (1) added to the container B to 164.0 parts respectively and not performing the second power feed addition method, in the preparation of the toner particles (1).

The obtained toner particle (C1) has a volume average particle diameter of 5.8

Toner (C1) and a developer (C1) are obtained using the toner particles (C1), in the same manner as in Example 1.

Various Measurement

Regarding toner of the developer obtained in each example, the maximum values (maximum value (1) and maximum value (2)) of distribution of the degree of uneven distribution B of the release agent domain, the frequency of the maximum value (1)/frequency of the maximum value (2) (in Table, noted as "frequency ratio") are determined based on the method described above.

The results are shown in Table 1.

Evaluation

The following evaluation is performed using the developer obtained in each example. The results are shown in Table 1.

Image Forming

The following operation and the image forming are performed in the environment of temperature of 25° C. and humidity of 60%.

As an image forming apparatus which forms an image for evaluation, an apparatus obtained by modifying 700 Digital Color Press manufactured by Fuji Xerox Co., Ltd. so as to output a non-fixed image to an edge of the paper is prepared, and the developer is added in a developing device, and replenishment toner (same toner as the toner contained in the developer) is added to a toner cartridge. Then, a solid image with no margin at concentration of 200% of a secondary color is formed on the plain paper having a thickness of 0.2 mm (cardboard), a fixing temperature is set to 190° C., a process speed is set to 160 mm/sec, and 100 images are continuously output.

Evaluation of Peeling Properties

Regarding the obtained 100th image, a state of the edge of the sheet is observed and evaluated based on the following criteria. A, B, and C are set as acceptable ranges.

A: Peeling defects are not observed and the state of the edge of the sheet is also excellent B: Peeling defects has not occurred, but gloss on the edge of the sheet is slightly low C: Peeling defects has not occurred, but gloss roughness on the edge of the image is observed D: variation in gloss is observed on the entire image Evaluation of Bending Resistance The 100 obtained images are bent so that the image comes to the outer side and unbent after 1 minute, and the maximum breadth of the image peeling of the bent portion is visually observed and evaluated based on the following criteria. A, B, and C are set as acceptable ranges.

A: No image peeling is observed

B: maximum breadth of the image peeling is smaller than 0.1 mm

C: maximum breadth of the image peeling is equal to or greater than 0.1 mm and smaller than 0.3 mm D: maximum breadth of the image peeling is equal to or greater than 0.3 mm Evaluation of Abrasion Resistance A symbol of "x" having a size of 1 cm×1 cm is written on the 100 obtained images with an HB pencil and the symbol is erased using a plastic eraser. A state of the image around the symbol "x" at that time is visually observed and evaluated based on the following criteria. A, B, and C are set as acceptable ranges.

A: there is no difference between the erased part and the non-erased part

B: the density of the image is slightly low, compared to that of the non-erased part C: the density of the image is low, compared to that of the non-erased part, but it is in an acceptable range D: the density of the image is obviously low, compared to that of the non-erased part, and toner is attached to the eraser.

TABLE 1

| | Distribution of degree of uneven distribution B of release agent domain | | | Evaluation | | |
|---|---|---|---|---|---|---|
| | Maximum value (1) | Maximum value (2) | Frequency ratio | Peeling properties | Bending resistance | Abrasion resistance |
| Ex. 1 | 0.50 | 0.85 | 0.33 | A | A | A |
| Ex. 2 | 0.37 | 0.77 | 0.25 | A | A | A |
| Ex. 3 | 0.37 | 0.95 | 0.43 | A | A | A |
| Ex. 4 | 0.64 | 0.77 | 0.19 | A | A | A |
| Ex. 5 | 0.64 | 0.95 | 0.59 | A | A | A |
| Ex. 6 | 0.37 | 0.70 | 0.33 | A | B | B |
| Ex. 7 | 0.70 | 0.85 | 0.33 | A | B | B |
| Ex. 8 | 0.30 | 0.95 | 0.33 | A | C | C |
| Ex. 9 | 0.50 | 0.85 | 0.33 | A | B | A |
| Com. Ex. 1 | 0.85 | — | — | B | D | D |

From the results, in Examples, it is found that the excellent results regarding the bending resistance and the abrasion resistance are obtained, compared to Comparative Example.

Particularly, in Examples in which the maximum value (1) of the distribution of the degree of uneven distribution B of the release agent domain is in a range of 0.35 to 0.65, the maximum value (2) of the distribution of the degree of uneven distribution B of the release agent domain is in a range of 0.75 to 1.00, and the frequency ratio is from 0.2 to 0.5, it is found that the excellent results regarding all of the peeling properties, the bending resistance, and the abrasion resistance are obtained.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a toner particle that has a sea-island structure including a sea portion containing a binder resin and an island portion containing a release agent and having at least two distinct peaks having maximum values of distribution of a degree of uneven distribution B of the island portion shown by the following Equation (1):

$$\text{degree of uneven distribution } B = 2d/D \qquad \text{Equation (1)}$$

wherein:

in Equation (1), D represents an equivalent circle diameter (μm) of the toner particle obtained by cross section observation of the toner particle, and d represents a distance (μm) between the center of gravity of the toner particle and the center of gravity of the island portion containing the release agent obtained by cross section observation of the toner particle, and all of the maximum values of distribution of the degree of uneven distribution B of the toner particle are in a range of 0.35 to 1.00.

2. The electrostatic charge image developing toner according to claim 1, wherein two values having a highest and second highest frequencies, respectively, among the maximum values of the distribution of the degree of uneven distribution B of the toner particle are a maximum value a1 in the range of 0.35 to 0.65 and a maximum value b1 in the range of 0.75 to 1.00, and the frequency of the maximum value a1 and the frequency of the maximum value b1 satisfy a relationship of the following Equation (2):

frequency of maximum value all frequency of maximum value $b1$=0.2 to 0.5. Equation (2)

3. The electrostatic charge image developing toner according to claim 2, wherein, when the island portion configuring a peak including the maximum value a1 contains a first release agent and the island portion configuring a peak including the maximum value b1 contains a second release agent, a melting temperature of the first release agent is higher than a melting temperature of the second release agent.

4. The electrostatic charge image developing toner according to claim 1, wherein the release agent is a hydrocarbon wax.

5. The electrostatic charge image developing toner according to claim 3, wherein the melting temperature of the first release agent is from 80° C. to 120° C.

6. The electrostatic charge image developing toner according to claim 1, wherein a melting temperature of the release agent is from 50° C. to 110° C.

7. The electrostatic charge image developing toner according to claim 1, wherein a content of the release agent is from 1% by weight to 20% by weight with respect to the entire toner particle.

8. The electrostatic charge image developing toner according to claim 1, wherein the binder resin is a polyester resin.

9. The electrostatic charge image developing toner according to claim 8, wherein a glass transition temperature (Tg) of the polyester resin is from 50° C. to 80° C.

10. The electrostatic charge image developing toner according to claim 8, wherein a weight average molecular weight (Mw) of the polyester resin is from 5,000 to 1,000,000.

11. The electrostatic charge image developing toner according to claim 8, wherein a molecular weight distribution Mw/Mn of the polyester resin is from 1.5 to 100.

12. The electrostatic charge image developing toner according to claim 1, wherein a shape factor SF1 of the toner particle is from 110 to 150.

13. The electrostatic charge image developing toner according to claim 1, wherein hydrophobic silica is attached to a surface of the toner particle.

14. An electrostatic charge image developer containing the electrostatic charge image developing toner according to claim 1.

15. The electrostatic charge image developer according to claim 14, wherein the developer contains a resin coated carrier.

16. The electrostatic charge image developer according to claim 15, wherein carbon black is contained in the resin of the resin coated carrier.

17. A toner cartridge that accommodates the electrostatic charge image developing toner according to claim 1 and is detachable from an image forming apparatus.

* * * * *